US009966698B2

(12) United States Patent
Yayama et al.

(10) Patent No.: US 9,966,698 B2
(45) Date of Patent: May 8, 2018

(54) SOCKET HAVING RELAY HOLDING LEVER

(71) Applicant: OMRON Corporation, Kyoto-shi, Kyoto (JP)

(72) Inventors: Keishi Yayama, Ritto (JP); Shunkichi Sasaki, Osaka (JP); Ikuo Matsukawa, Ota-ku (JP)

(73) Assignee: OMROM Corporation, Kyoto-shi (JP)

( * ) Notice: Subject to any disclaimer, the term of this patent is extended or adjusted under 35 U.S.C. 154(b) by 0 days. days.

(21) Appl. No.: 15/624,909

(22) Filed: Jun. 16, 2017

(65) Prior Publication Data

US 2018/0019543 A1 Jan. 18, 2018

(30) Foreign Application Priority Data

Jul. 14, 2016 (JP) ..... 2016-139527

(51) Int. Cl.
*H01R 13/62* (2006.01)
*H01R 13/629* (2006.01)
*H01R 13/631* (2006.01)

(52) U.S. Cl.
CPC ..... *H01R 13/62955* (2013.01); *H01R 13/631* (2013.01)

(58) Field of Classification Search
CPC ..... H01R 13/6335; H01R 13/639
USPC ..... 439/153, 155, 160
See application file for complete search history.

(56) References Cited

U.S. PATENT DOCUMENTS 2,449,646 A * 9/1948 Emde ..... H01R 33/975 248/505
2,539,581 A * 1/1951 Holden ..... H01R 33/975 248/505
2,575,601 A * 11/1951 Staver ..... H01R 33/975 174/395

(Continued)

FOREIGN PATENT DOCUMENTS

DE 102013222959 A1 5/2015
EP 1052731 A2 11/2000
WO 2013132808 A1 9/2013

OTHER PUBLICATIONS

The extended European search report (EESR) dated Oct. 24, 2017 in a counterpart European patent application.

*Primary Examiner* — Neil Abrams
(74) *Attorney, Agent, or Firm* — Metrolexis Law Group PLLC

(57) ABSTRACT

A socket includes a socket body having a mounting part, and a holding lever supported on the mounting part to hold a relay mounted at a mounting position of the mounting part. The holding lever includes a support, and a stopper provided on the support and movable between a restriction position at which movement of the relay, positioned at the mounting position, in a removing direction is restricted and a restriction release position at which the restriction of the movement of the relay in the removing direction is released. The holding lever is supported on the mounting part to be movable between a retreat position at which a relay can be mounted and removed and a holding position at which a relay positioned at the mounting position can be held when the stopper is positioned at the restriction position such that the stopper covers a center-of-gravity position of the relay.

19 Claims, 7 Drawing Sheets

(56) References Cited

U.S. PATENT DOCUMENTS 2,673,334 A * 3/1954 Julian ..... H01R 33/975 248/505
3,008,115 A * 11/1961 Oakes ..... H01R 13/633 29/764
3,061,761 A * 10/1962 Blain ..... H01R 13/6215 361/784
3,918,786 A * 11/1975 Chaney ..... H01R 13/62933 29/259
4,501,455 A * 2/1985 Groseck ..... E05B 17/0033 292/300
4,531,795 A * 7/1985 Sinclair ..... H01R 13/633 439/152
5,057,029 A * 10/1991 Noorily ..... H01R 13/633 439/157
5,395,258 A * 3/1995 Okumura ..... H01R 13/62933 439/157
6,056,582 A * 5/2000 Okabe ..... H01R 13/62933 439/372
6,142,787 A * 11/2000 Ikesugi ..... H01R 13/62933 439/15
6,164,991 A * 12/2000 Matsuura ..... H01R 13/6275 439/157
6,629,852 B2 * 10/2003 Mori ..... H01R 13/639 439/153
7,789,681 B2 * 9/2010 Guan ..... H01R 12/7005 439/157
7,833,042 B2 * 11/2010 Nishio ..... G02B 6/4201 439/331
8,083,531 B1 * 12/2011 Ourasanah ..... H01R 13/6335 439/159
8,579,639 B2 * 11/2013 Bodmann ..... H05K 7/1468 439/155
8,771,006 B1 * 7/2014 Blinson ..... H01R 13/6335 439/484
9,060,427 B2 * 6/2015 Binner ..... H05K 5/0247

* cited by examiner

SOCKET HAVING RELAY HOLDING LEVER

CROSS-REFERENCE TO RELATED APPLICATION

This application is based on Japanese Patent Application No. 2016-139527 filed with the Japan Patent Office on Jul. 14, 2016, the entire contents of which are incorporated herein by reference.

FIELD

The disclosure relates to a socket to which a relay is detachable.

BACKGROUND

In general, a relay is wired through a socket in some cases. Examples of such a socket include one described in EP1052731. That socket is equipped with: a socket body configured to be mounted on a board and having a mounting part on which a relay is to be mounted from a predetermined mounting direction; and a holding lever supported on the mounting part of the socket body and configured to hold a relay mounted on the mounting part.

The holding lever of the socket has: a pair of support walls, which is disposed to sandwich, in a width direction of the relay, the mounting part to which a rectangular parallelepiped relay can be mounted, and on which protrusions are provided facing each other; an operation part provided on the ends, of the pair of support walls, distal to the socket body, the operation part provided across between the pair of support walls; and a rotation shaft provided on the ends of the pair of support walls proximal to the socket body, the rotation shaft provided across between the pair of support walls. In this arrangement, the holding lever is configured to rotate, around the rotation shaft, between a retreat position at which the relay mounted at a mounting position of the mounting part can be removed and a holding position at which the relay positioned at the mounting position can be held.

In the above-described socket, a relay is held by the protrusions each provided on each of the pair of support walls or by a stopper extending toward the socket body from the operation part.

However, because the protrusions each provided on each of the pair of support walls are too small and because, in the plan view from the mounting direction, the stopper provided on the operation part is positioned at the end part, of the relay, in the longitudinal direction, the force for holding the relay in the mounting position is weak. Thus, when a vibration or impact is applied to the socket mounted at the mounting position of the relay, the relay can unintentionally fall off from the mounting position.

SUMMARY

To address this issue, an object of an embodiment of the invention is to provide a socket which can more reliably prevent a relay from unintentionally falling off.

A socket of one aspect of the invention may include: a socket body having a mounting part on which a relay is to be mounted in a mounting direction; and a holding lever supported on the mounting part of the socket body and configured to hold the relay mounted at a mounting position of the mounting part. The holding lever has: a support extending from the mounting part of the socket body in a removing direction opposite to the mounting direction; and a stopper provided on an end part of the support distal to the socket body in the removing direction and configured to restrict movement of the relay, positioned at the mounting position, in the removing direction. The stopper is provided on the support and configured to move between a restriction position at which the stopper restricts movement of the relay, positioned at the mounting position, in the removing direction from the mounting part and a restriction release position at which the stopper releases the restriction of the movement of the relay, positioned at the mounting position, in the removing direction from the mounting part. The holding lever is supported on the mounting part and configured to move between a retreat position at which, when the stopper is positioned at the restriction release position, a relay can be mounted at the mounting position of the mounting part and the relay mounted at mounting position can be removed and a holding position at which the relay positioned at the mounting position can be held when the stopper is positioned at the restriction position such that the stopper covers, in a plan view from the mounting direction, a center-of-gravity position of the relay.

A socket of one aspect of the invention may include: a stopper configured to move between a restriction position at which a relay cannot be removed and a restriction release position at which the relay is released; and a holding lever configured to hold the relay positioned at a mounting position when the stopper is positioned at the restriction position such that the stopper covers, in a plan view from a mounting direction, a center-of-gravity position of the relay. This arrangement can reliably prevent the relay from unintentionally falling off from the mounting part of the socket body.

DETAILED DESCRIPTION

Hereinafter, an embodiment of the invention will be described with reference to the accompanying drawing. In the following description, words and terms representing certain directions and positions (words and terms including "up," "down," "right," and "left" are used, for example) are used if necessary; however, those words and terms are used to make the invention be understood easily with reference to the drawings, and the meanings of those words and terms do not limit the technical scope of the invention. Further, the following description is essentially just an example of the invention, and it is not intended to limit application targets or uses of the invention. In addition, the drawings are schematically drawn, and the ratios of the sizes are not the same as those of the actual sizes.

First Embodiment

Figure 1:
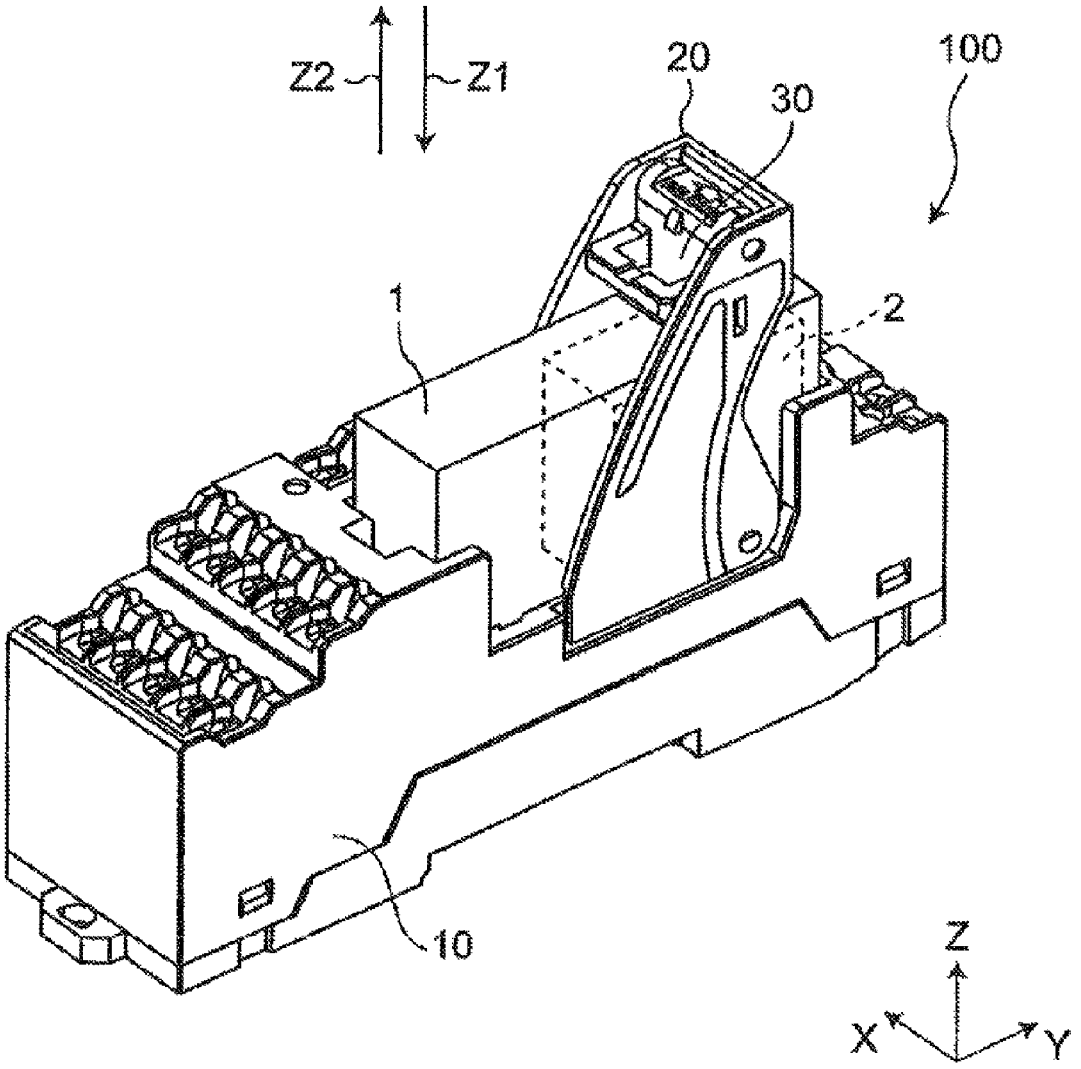
FIG. 1 is a perspective view showing a socket of a first embodiment of the invention when a relay is mounted in a socket body.

A socket 100 of a first embodiment of the invention has insulation properties, and, as shown in FIG. 1, the socket 100 is equipped with: a socket body 10 which is in an approximate rectangular box shape and is mountable on a board; and a holding lever 20 rotatably supported on the socket body 10.

The socket 100 is a member configured to electrically connect terminals of a detachably mounted relay 1, conductor parts of electric wires, and electrodes on the board with one another, and after the socket 100 is assembled on the board, only the relay 1 is detachable to the socket body 10 of the socket 100, so that it is easy to repair or replace the relay 1.

Note that hereinafter the width direction of the socket body 10 is the X direction, the longitudinal direction of the socket body 10 is the Y direction, and the height direction of the socket body 10 perpendicular to the X direction and the Y direction is the Z direction.

An example of the relay 1 is an elongated rectangular box shaped relay for board-mount use and has a coil 2 at one internal end, in the longitudinal direction, of the relay 1 as shown in FIG. 1. Further, a plurality of terminals (not shown) are provided on the lower side surface, in the Y direction, of the relay 1. Note that the relay 1 is mounted in the socket body 10 in the direction Z1 (directed from up to down) in FIG. 1 and removed from the socket body 10 in the direction Z2 (directed from down to up) in FIG. 1. That is, the mounting direction of the relay 1 with respect to the socket body 10 is Z1, and the removing direction is Z2.

Figure 2:
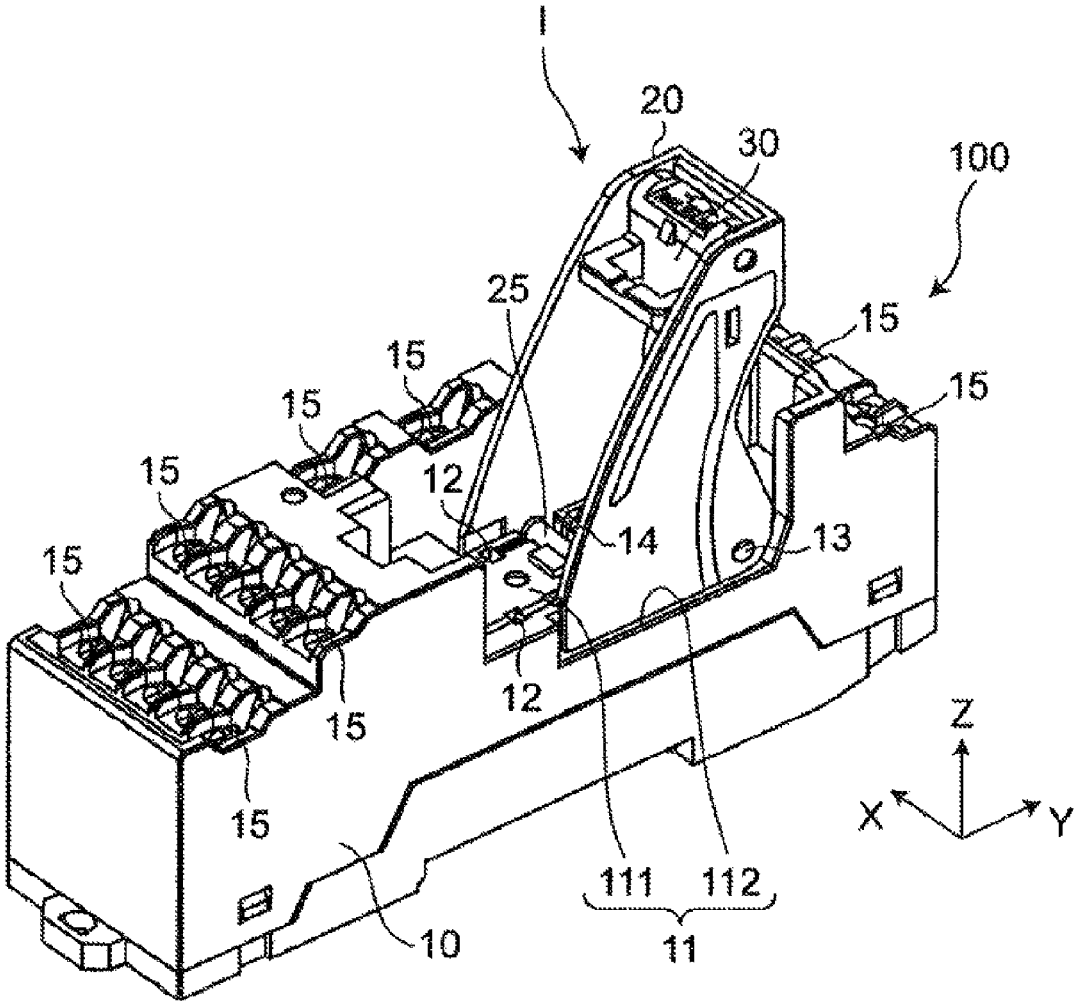
FIG. 2 is a perspective view showing the socket of FIG. 1 when the relay is removed from the socket body.

As shown in FIG. 2, the socket body 10 has, on the upper side thereof in the Z direction, a mounting part 11 on which the relay 1 is to be mounted. The mounting part 11 has a concave shape in which the right side in the X direction and the upper side in the Z direction are open, and extends in the direction (Y direction) in which the socket body 10 extends.

On a bottom surface of the mounting part 11, there are provided a relay mounting surface 111 extending in the longitudinal direction (Y direction) of the socket body 10 and lever mounting surfaces 112 provided, in the direction in which the relay mounting surface 111 extends, so as to sandwich the relay mounting surface 111. The lever mounting surfaces 112 are provided at positions (positions to which the straight line distances from the opening on the upper side in the Z direction is longer than the straight line distance to the relay mounting surface 111) lower than the relay mounting surface 111 and are disposed between the both ends of the relay mounting surface 111 in the longitudinal direction.

In the relay mounting surface 111, there are provided a plurality of terminal holes 12 into which a plurality of terminals 3 (shown in FIG. 9) of the relay 1 are inserted and a groove portion 14 in which a removing rod 25 of the holding lever 20 (to be described later) is stored. Further, on the lever mounting surfaces 112, there is provided a shaft 13 to rotatably support the holding lever 20.

Note that, the position at which the relay 1 is mounted on the relay mounting surface 111 shown in FIG. 1 is defined as a mounting position of the relay 1.

The terminal holes 12 are arranged depending on, for example, the type of the relay 1 to be mounted so as to be electrically connected to the terminals 3 of the relay 1. The shaft 13 is disposed on the end part on the right side, in the Y direction, of the bottom surface of the mounting part 11 and extends in the short side direction (X direction) of the socket body 10. The shaft 13 constitutes a first rotation shaft, being inserted in a lever-shaft receiving holes 26 in the holding lever 20. A shaft center of the first rotation shaft (the shaft 13) is perpendicular to the mounting direction Z1 and the removing direction Z2 of the relay 1 and functions as a rotation axis X1 (shown in FIG. 3) of the holding lever 20. The groove portion 14 is disposed at an approximately central part of the bottom surface of the mounting part 11 and extends along the X direction of the socket body 10.

Further, in the periphery of the mounting part 11 on the upper surface of the socket body 10, there are provided a plurality of terminal connection parts 15 in which conductor parts of electric wires are inserted and fixed. The terminal connection parts 15 are electrically connected to the terminal holes 12 of the bottom surface of the mounting part 11.

Figure 3:
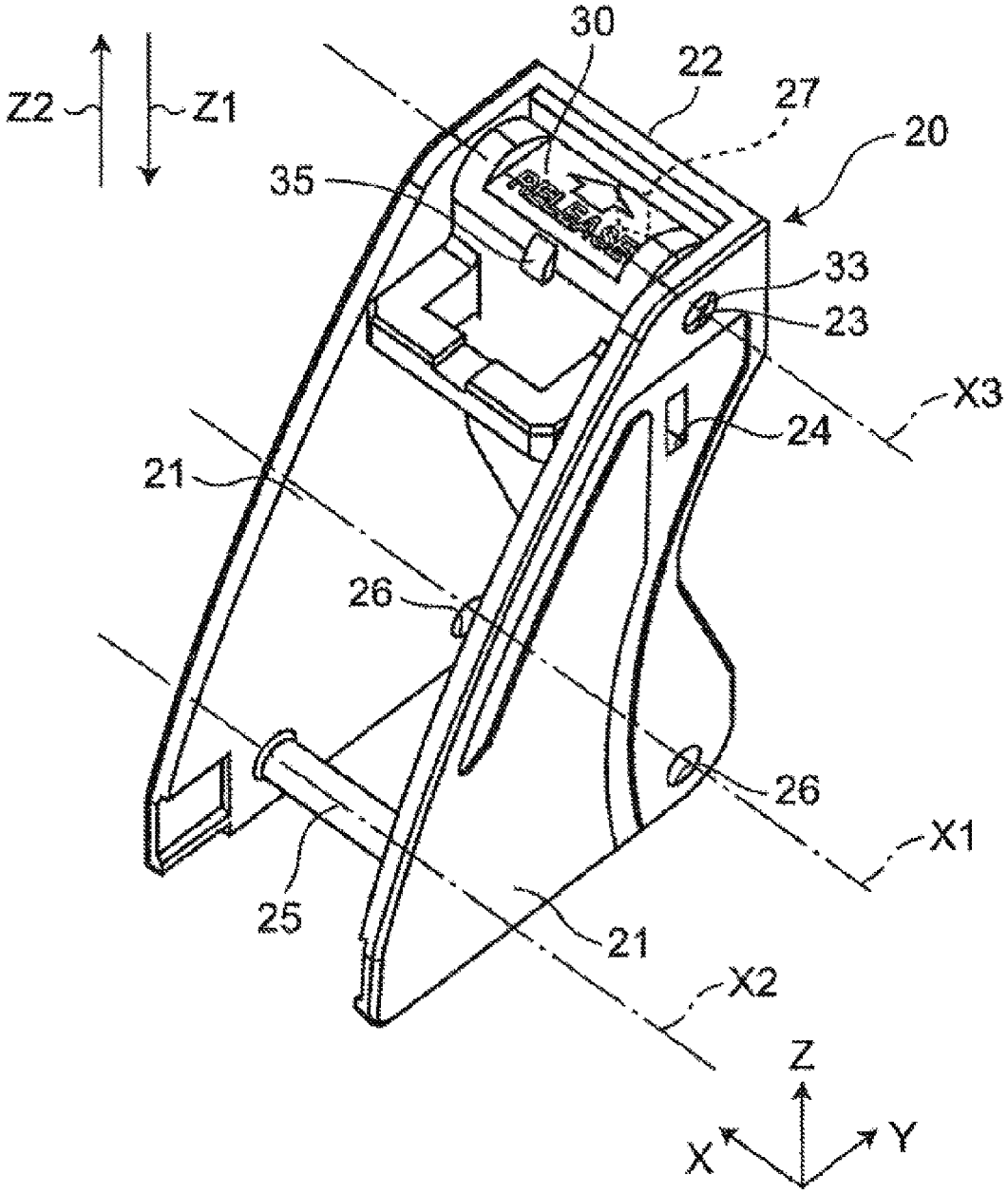
FIG. 3 is a perspective view showing a holding lever of the socket of FIG. 1.

As shown in FIG. 3, the holding lever 20 has: a pair of support walls 21 (which is an example of the support) provided with a distance therebetween in the X direction to sandwich the mounting part 11; and a stopper 30 provided at the end parts, of the pair of support walls 21, distal to the socket body 10 in the removing direction Z2 of the relay 1 (the end parts are on the upper side in the Z direction). Each of the pair of support walls 21 has a fan-like shape centered at the shaft center of each of the lever-shaft receiving holes 26 (to be described later). Further, the stopper 30 is supported on the pair of support walls 21 to be rotatable within a predetermined angle range (for example, 90 degrees).

On the end parts on the upper side, in the Z direction, of the pair of support walls 21, there are provided a connecting wall 22 to connect between the pair of support walls 21 and stopper shaft receiving holes 23 in which shafts 33 of the stopper 30 (to be described later) are inserted. The connecting wall 22 is provided on the right side, in the Y direction, of the upper ends of the pair of support walls 21 so as to define a rotation range of the stopper 30. In addition, in the connecting wall 22, there is provided a second engagement receiving part 27 with which a second engagement protrusion 35 of the stopper 30 to be described later is releasably engaged.

Further, on the lower part, in the Z direction, than each of the stopper shaft receiving holes 23 of the pair of support walls 21, there is provided a first engagement receiving part 24 with which each of first engagement protrusions 34 of the stopper 30 to be described later is engaged.

On the left side, in the Y direction, on the end part (on the lower end part in the Z direction) proximal, in the removing direction Z2 of the relay 1, to the socket body 10 of the pair of support walls 21, the removing rod 25 is provided, in the X direction, across between the pair of support walls 21. That is, the removing rod 25 is disposed with a shaft center X2 thereof being approximately parallel to the rotation axis X1 of the holding lever 20. Further, in the right side, in the Y direction, of the lower end part, in the Z direction, of each of the pair of support walls 21, the lever-shaft receiving hole 26 is provided, and the shaft 13 of the mounting part 11 of the socket body 10 is inserted in each of the lever-shaft receiving holes 26. With this arrangement, the holding lever 20 is rotatably supported on the mounting part 11 of the socket body 10.

That is, the holding lever 20 is configured to rotate around the rotation axis X1, which is the shaft center of the shaft 13, between (i) a retreat position II (see FIG. 8) at which the relay 1 mounted at the mounting position can be removed and a holding position I (shown in FIG. 1 and FIG. 6) at which the relay 1 positioned at the mounting position can be held.

Figure 4:
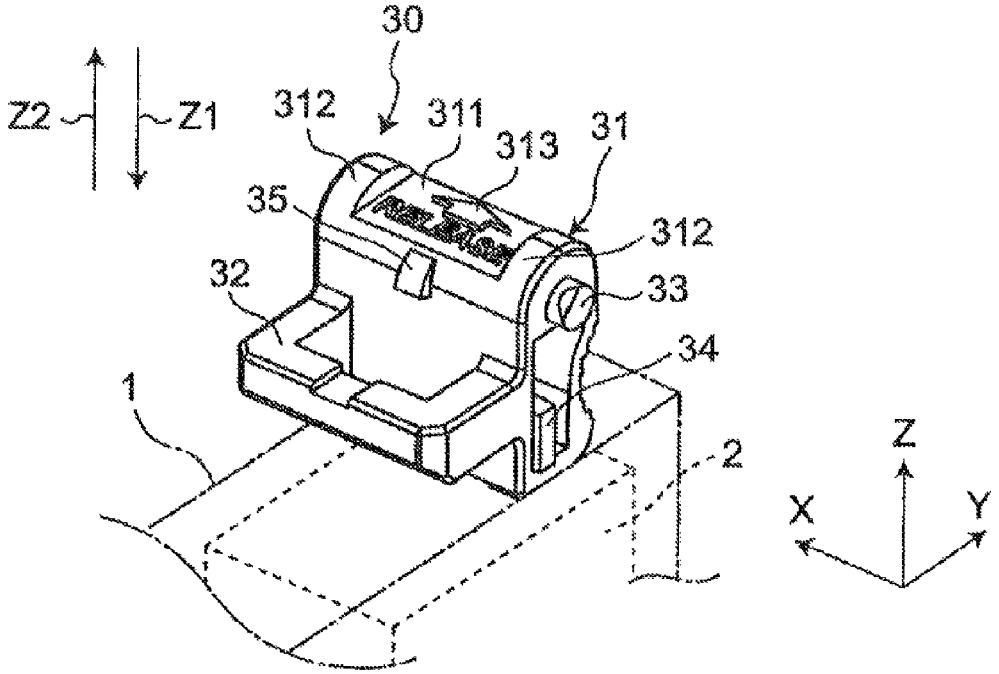
FIG. 4 is a perspective view showing a stopper, of the socket of FIG. 1, at a restriction position.

As shown in FIG. 4, the stopper 30 is constituted by a rectangular plate-shaped main body 31 and an operation part 32 provided on the main body 31. The stopper 30 is disposed such that the stopper 30 covers, in a plan view from the mounting direction Z1, a center-of-gravity position P of the relay 1 (shown in FIG. 7) when the holding lever 20 is at the holding position I. In addition, the stopper 30 is disposed such that the holding lever 20 does not interfere with the mounting or removal of the relay 1 when the stopper 30 is at the retreat position II.

The main body 31 is mostly configured with a thick plate-like member and has the approximately cylinder-shaped shafts 33 each extending from each of the one end parts (the upper end parts in the Z direction in FIG. 4) of the both side surfaces (the surfaces in the X direction in FIG. 4). The shafts 33 extend approximately parallel to the shaft 13 of the mounting part 11 of the socket body 10 and the removing rod 25 on the pair of support walls 21. Further, the shafts 33 are inserted in the stopper shaft receiving holes 23 of the pair of support walls 21 so that the stopper 30 is rotatably supported on the pair of support walls 21. That is, the shafts 33 constitute a second rotation shaft, and the shaft center of the second rotation shaft is a rotation axis X3 (shown in FIG. 3) of the stopper 30.

That is, the stopper 30 is configured to rotate around the rotation axis X3, which is the shaft center of the shafts 33, between a restriction position III (shown in FIG. 4) at which the movement of the relay 1 from the mounting part 11 to the removing direction Z2 can be restricted and a restriction release position IV (see FIG. 8) at which the restriction of the movement of the relay 1 from the mounting part 11 to the removing direction Z2 can be released.

Note that the restriction release position is the position at which the stopper 30 at the restriction position III has been rotated by 180 degrees, and the main body 31 of the stopper 30 at the restriction position III and the main body 31 of the stopper 30 at the restriction release position IV are positioned on the same straight line perpendicular to the rotation axis X3 of the stopper 30.

Further, on the other end parts (the lower end parts in the Z direction in FIG. 4) of the both side surfaces of the main body 31, the first engagement protrusions 34 are provided. The first engagement protrusions 34 and the engagement receiving parts 24 of the pair of support walls 21 can be locked (detachably held) with each other by snap fit and constitute a first locking mechanism to be used to lock the stopper 30 at the restriction position III and to release the locking of the stopper 30 at the restriction position III.

At the central part of the end face on the side on which the shafts 33 of the main body 31 are provided, a flat part 311 is provided as shown in FIG. 4, and on the both ends of the flat part 311 in the longitudinal direction (the X direction in FIG. 4), there are provided curved parts 312 curved along the shape of the shafts 33. On the flat part 311, there is provided an arrow 313 to indicate the rotation direction to move the stopper 30 from the restriction position III to the restriction release position IV.

Figure 5:
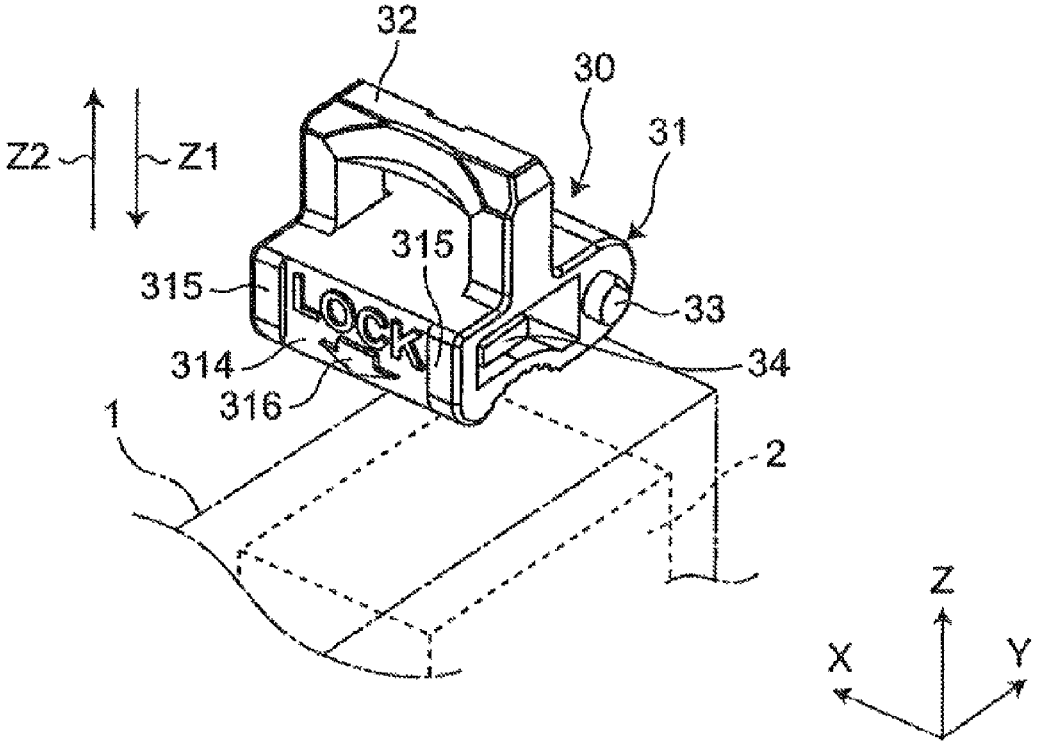
FIG. 5 is a perspective view showing the stopper, of the socket of FIG. 1, turned from the restriction position toward a restriction release position by 90 degrees.

At the central part on the end face on the side on which the engagement protrusions 34 of the main body 31 are provided, a flat part 314 is provided as shown in FIG. 5, and on the both ends of the flat part 314 in the longitudinal direction (the X direction in FIG. 5), there are provided a pair of restriction flat parts 315 protruding in the Y direction with respect to the flat part 314 at the restriction release position IV. On the flat part 314, there is provided an arrow 316 indicating the rotation direction for moving the stopper 30 from the restriction release position IV to the restriction position III.

Further, the pair of restriction flat parts 315 is configured such that when the holding lever 20 is at the holding position I and the stopper 30 is at the restriction position III, the restriction flat parts 315 are in contact with the relay 1 in the vicinity of the both end parts of the relay 1 in the width direction (X direction) so as to restrict the movement of the relay 1 in the removing direction Z2. By providing the pair of restriction flat parts 315 as described above, it is possible to restrict the movement of the relay 1 in the removing direction Z2 with a good balance.

The operation part 32 is protrudingly provided on one plate surface of the main body 31 (the left side surface in the Y direction in FIG. 4) and is disposed between the shafts 33 and the first engagement protrusions 34. The operation part 32 extends in the same direction as the shafts 33 extend.

Further, between the flat part 311 and the operation part 32 on the plate surface on which the operation part 32 of the main body 31 is provided, the second engagement protrusion 35 is provided. The second engagement protrusion 35 and the engagement receiving part 27 in the connecting wall 22 of the pair of support walls 21 can be locked with each other by snap fit and constitute a second locking mechanism to lock the stopper 30 at the restriction release position IV and to release the locking of the stopper 30 at the restriction release position IV.

Next, with reference to FIG. 6 to FIG. 9, a description will be given to the movement when the relay 1 mounted on the socket 100 is removed.

Figure 6:
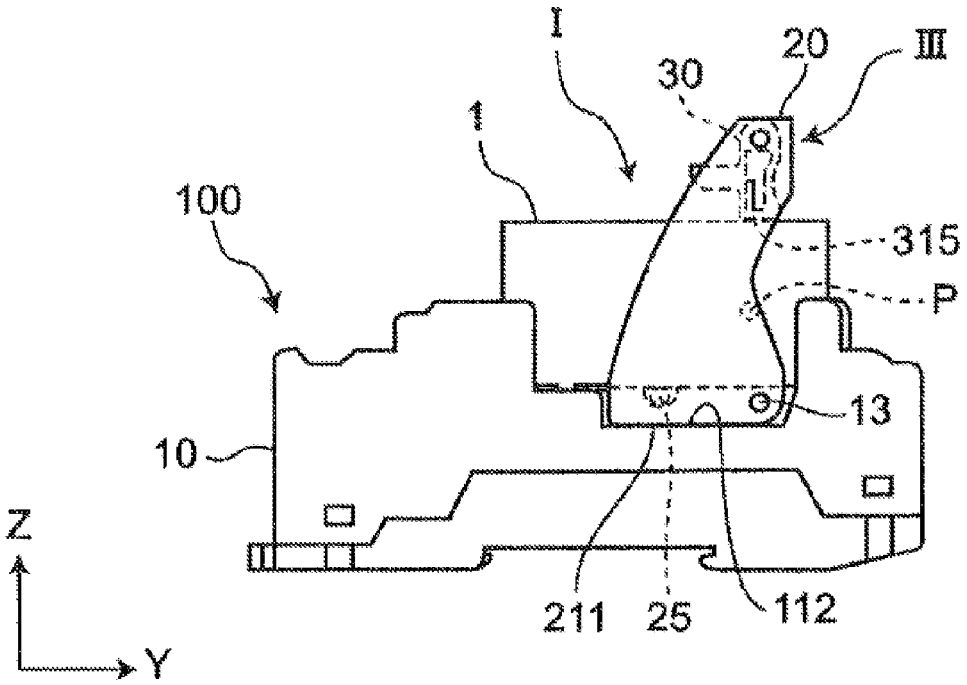
FIG. 6 is a diagram for illustrating movement when the relay is removed from the socket of FIG. 1.
Figure 8:
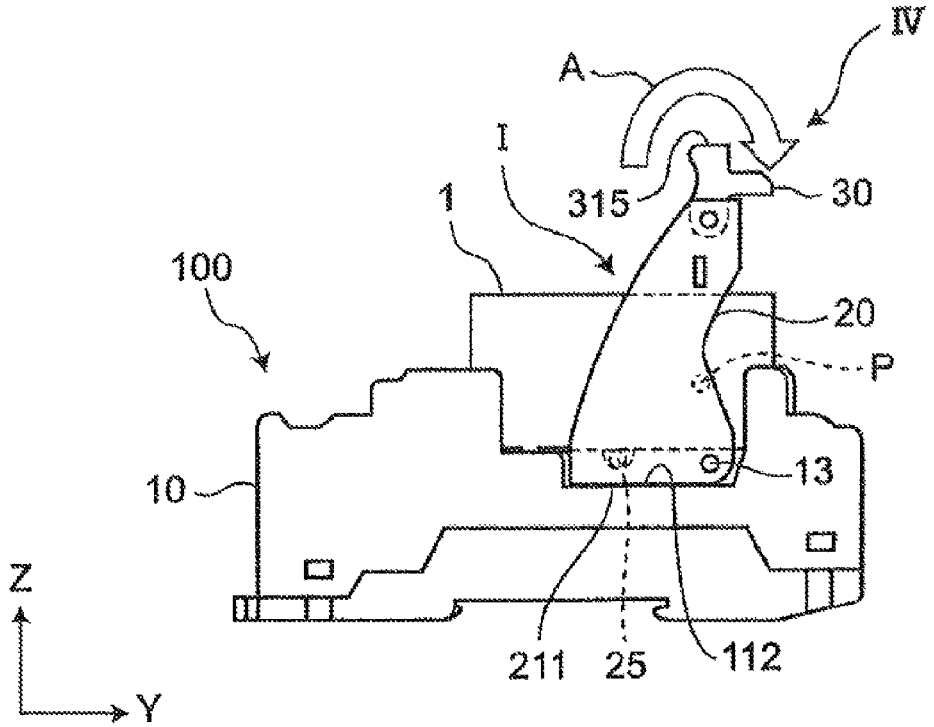
FIG. 8 is a diagram following FIG. 6 for illustrating the middle of the movement when the relay is removed from the socket of FIG. 1.

In the state shown in FIG. 8, by lowering the relay 1 in the mounting direction Z1 to press down the removing rod 25 and to rotate the holding lever 20 around the shaft 13 from the retreat position II to the holding position I, the relay 1 is mounted on the mounting part 11 of the socket body 10 as shown in FIG. 6. After that, the stopper 30 is rotated around the shafts 33 from the restriction release position IV to the restriction position III.

Figure 7:
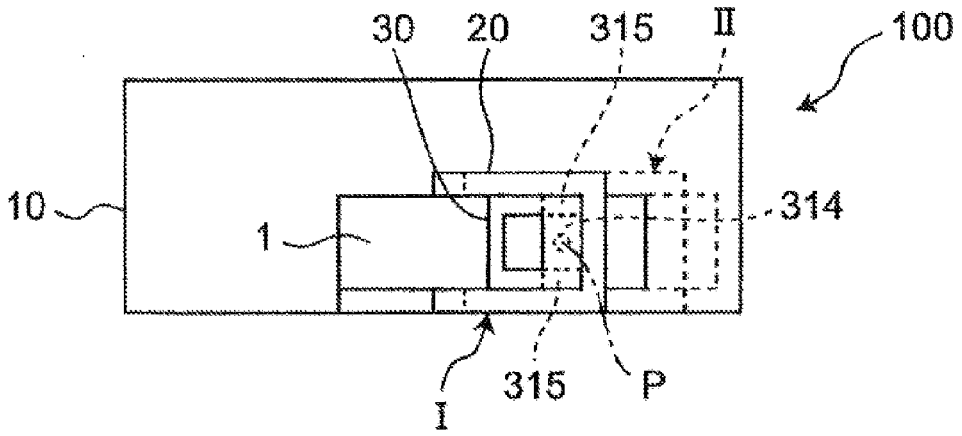
FIG. 7 is a plan view from a mounting direction of the relay for illustrating a positional relationship between the stopper of the socket and the relay of FIG. 1.

At this time, the pair of restriction flat parts 315 of the stopper 30 comes in contact with the both end parts in the width direction of the upper surface of the relay 1, and the flat part 314 between the pair of restriction flat parts 315 of the stopper 30 covers, in the plan view in which the relay 1 is viewed from the mounting direction Z1, a center-of-gravity position P of the relay 1 as shown in FIG. 7.

Further, when the holding lever 20 is at the holding position I, faces 211 facing the pair of support walls 21 of the lever mounting surfaces 112 of the mounting part 11 of the socket body 10 are in contact with the lever mounting surfaces 112, and the removing rod 25 is between the relay 1 positioned at the mounting position and the lever mounting surfaces 112 of the mounting part 11 of the socket body 10.

First, as shown in FIG. 8, the operation part 32 of the stopper 30 is pinched by fingers and operated such that the stopper 30 locked at the restriction position III by the first locking mechanism is rotated in the direction A of the arrow 313, whereby the stopper 30 is moved from the restriction position III to the restriction release position IV. In this operation, the operation part 32 of the stopper 30 comes in contact with the connecting wall 22 of the pair of support walls 21, so that the rotation of the stopper 30 in the direction A of the arrow 313 is restricted and so that the stopper 30 is locked at the restriction release position IV by the second locking mechanism.

Figure 9:
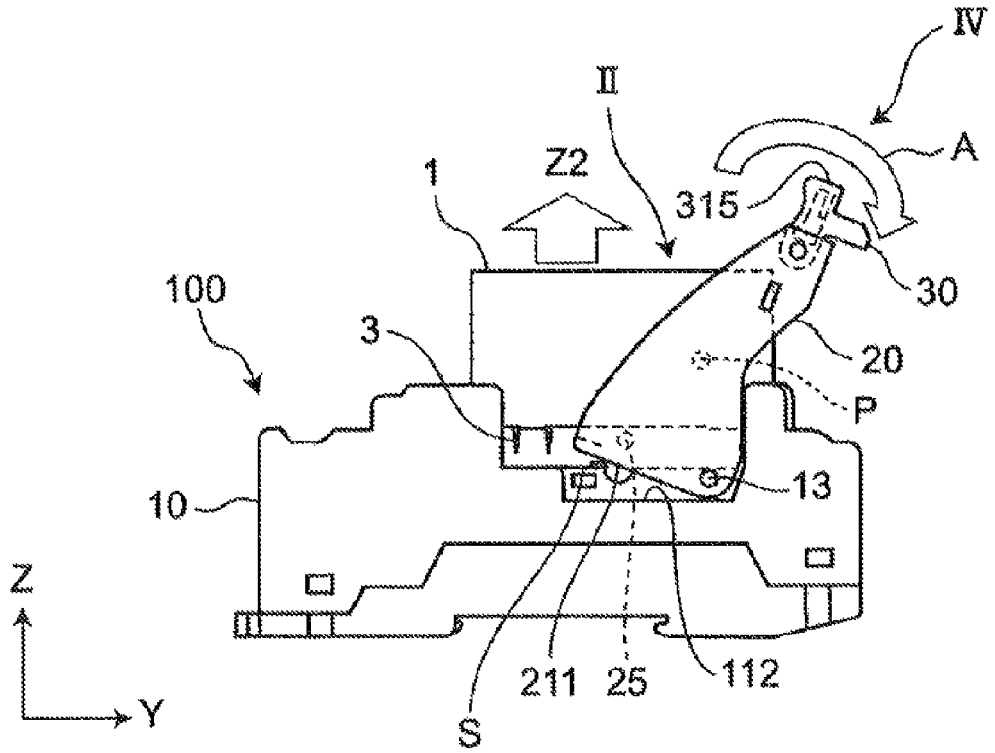
FIG. 9 is a diagram following FIG. 8 for illustrating the movement when the relay is removed from the socket of FIG. 1.

After the stopper 30 moves to the restriction release position IV and get locked at the restriction release position IV by the second locking mechanism, the holding lever 20 is rotated in the direction A of the arrow 313 as shown in FIG. 9 and is thus moved from the holding position I to the retreat position II. In this operation, the removing rod 25 between the lower surface of the relay 1 and the mounting part 11 of the socket body 10 pushes the relay 1 in the removing direction Z2 along with the rotational movement of the holding lever 20 and moves the relay 1. By this operation, the terminals 3 of the relay 1 are pulled out from the terminal holes 12, and the relay 1 is removed from the mounting part 11 of the socket body 10.

Further, when the holding lever 20 is at the retreat position, a gap S is formed between the faces 211 of the pair of support walls 21 facing the lever mounting surfaces 112 of the mounting part 11 of the socket body 10 and the lever mounting surfaces 112.

In a conventional socket in which a relay is detachable, the stopper is at the end part away from the center-of-gravity position of the relay in the plan view from the mounting direction; therefore, the force for holding the relay at the mounting position is so weak that the relay may unintentionally fall off from the mounting position when a vibration or impact is applied to the conventional socket.

The socket 100 of the first embodiment is equipped with the holding lever 20, and the holding lever 20 has the stopper 30 which is movable between (i) the restriction position III at which the relay 1 cannot be removed and (ii) the restriction release position IV at which the relay is released; and when the stopper 30 is at the restriction position III such that the stopper 30 covers, in the plan view from the mounting direction Z1, the center-of-gravity position P of the relay 1, the relay 1 positioned at the mounting position can be held. This arrangement increases the force for holding the relay 1 at the mounting position, whereby it is possible to prevent the relay 1 from unintentionally falling off from the mounting part of the socket body 10.

Further, the holding lever 20 is supported on the mounting part 11 of the socket body 10 and can rotatably move, around the rotation axis perpendicular to the mounting direction Z1 and the removing direction Z2, between the retreat position and the holding position. Further, when the holding lever 20 is at the holding position, the stopper 30 can move between (i) the restriction position at which it is possible to restrict the movement of the relay 1 positioned at the mounting position from the mounting part 11 to the removing direction Z2 and (ii) the restriction release position at which it is possible to release the restriction of the movement of the relay 1 positioned at the mounting position from the mounting part 11 to the removing direction Z2. This arrangement makes it easy to mount the relay 1 on the mounting part 11 of the socket body 10 and to remove the relay 1 positioned at the mounting position from the mounting part 11 of the socket body 10.

Further, the holding lever 20 has the first lock mechanism to lock the stopper 30 at the restriction position. This arrangement can reliably prevent the relay 1 from unintendedly falling off from the mounting part of the socket body 10.

Further, the first lock mechanism is configured with the first engagement protrusions 34 provided on the stopper 30 and the engagement receiving parts 24 in the pair of support walls 21, and the first engagement protrusions 34 and the engagement receiving parts 24 are locked with each other by snap fit. This arrangement makes it easy to visually recognize that the stopper 30 is at the restriction position III, whereby the operability is improved.

Further, the pair of support walls 21 is provided as supports to sandwich the mounting part 11, the pair of support walls 21 can rotationally move around the shaft 13 between the retreat position and the holding position, and the stopper 30 can rotationally moves around the shafts 33 between the restriction position and the restriction release position. This arrangement can reduce the operation range of the holding lever 20 for mounting and removing the relay 1 on and from the socket body 10.

Further, the pair of support walls 21 has the removing rod 25 which is disposed between the pair of support walls 21 and is positioned between the relay 1 positioned at the mounting position and the socket body 10 when the holding lever 20 is at the holding position. This arrangement make it easy to remove the relay 1 positioned at the mounting position from the mounting part 11 of the socket body 10.

Note that the stopper 30 only has to be disposed such that the end face of the main body 31 on which the engagement protrusions 34 are provided covers, in the plan view from the mounting direction Z1, the center-of-gravity position P of the relay 1 when the holding lever 20 is at the holding position and the stopper 30 is at the restriction position. That is, the flat part 314 of the stopper 30 does not necessarily have to cover the center-of-gravity position P of the relay 1 in the plan view from the mounting direction Z1, and instead the stopper 30 may be disposed such that the restriction flat parts 315 covers the center-of-gravity position P of the relay 1.

The center-of-gravity position P of the relay 1 depends on the type or the like of the relay 1; and in the case of the relay 1 having therein the coil 2, the center of gravity P is deviated from the central part in the longitudinal direction of the relay 1 toward the coil 2 side. In addition, regarding the terminals protruding from the relay 1 having therein the coil 2, more of terminals are on the side on which the coil 2 is not disposed than on the side on which the coil 2 is disposed. Generally, the part having a smaller number of terminals tends to easily come out than the part having a greater number of terminals. For this reason, in the case of the relay 1 having therein the coil 2, by configuring such that the stopper 30 is positioned on the part having a smaller number of the terminals protruding from the relay 1, it is possible to prevent the relay 1 from unintentionally falling off from the mounting part of the socket body 10.

In the first embodiment, the holding lever 20 is rotatably supported on the mounting part 11 of the socket body 10, but the present invention is not limited thereto. The holding lever only has to be movable between the retreat position and the holding position, and, for example, the holding lever may be configured to be slidingly moved along the longitudinal direction of the socket body between the retreat position and the holding position.

Further, the pair of support walls 21 is used as the support, but the support is not limited thereto. The support only has to be a member which extends from the mounting part in the removing direction of the relay and can support the stopper, and, for example, the support may be configured with one or more than three support walls or with one or more rods.

Further, the stopper 30 is configured such that the pair of restriction flat parts 315 is in contact with the relay 1 in the vicinity of the both end parts of the width direction (X direction) of the relay 1 so as to restrict the movement of the relay 1 in the removing direction Z2 when the holding lever 20 is at the holding position I and the stopper 30 is at the restriction position III, but the stopper is not limited thereto. The stopper only has to restrict the movement of the relay in the removing direction with the pair of restriction flat parts so as to keep the electrical connections between the terminals of the relay and the terminal holes, and, for example, the pair of restriction flat parts and the relay may not be in contact with each other.

Further, the pair of restriction flat parts 315 of the stopper 30 is provided in the vicinity of the both end parts in the width direction of the relay 1, but are not limited thereto. For example, the pair of restriction flat parts 315 of the stopper 30 may be made to be in contact only with the vicinity of the central part in the width direction of the relay; or alternatively, the whole of the end face, of the main body, on the side on which the engagement protrusion is provided may be made a restriction flat part.

The removing rod 25 does not only have to be one, and a plurality of removing rods 25 may be provided. Further, the shaft center X2 of the removing rod 25 does not necessarily have to be disposed parallel to the rotation axis X1 of the holding lever 20. The removing rod can be arbitrarily disposed as long as the removing rod can move the relay in the removing direction from the mounting position along with the movement of the holding lever from the holding position to the retreat position.

If possible, a shaft functioning as the rotation shaft of the holding lever may be provided on the pair of support walls of the holding lever, and a relay-shaft receiving hole may be provided in the relay mounting surface of the socket body. In a similar way, a shaft functioning as the rotation shaft of the stopper may be provided on the pair of support walls of the holding lever, and a stopper shaft receiving hole may be provided in the stopper.

Further, it may be possible to omit the locking mechanism to lock the stopper 30 at the restriction position and the restriction release position and to omit the removing rod 25 of the pair of support walls 21.

Second Embodiment

Figure 10:
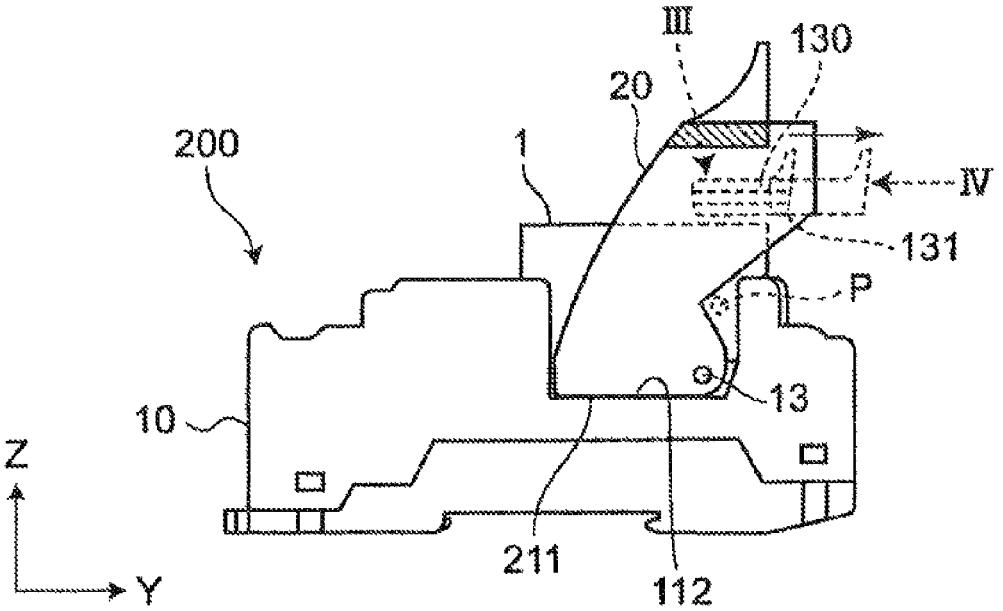
FIG. 10 is a side view of a socket of a second embodiment of the invention.

As shown in FIG. 10, a socket 200 of a second embodiment is different from the socket 100 of the first embodiment in that the socket 200 has a stopper 130 which can slidingly move between the restriction position III and the restriction release position IV.

Note that in the second embodiment, the same parts as in the first embodiment are assigned the same reference numerals and are not described again.

The stopper 130 is provided on the opposing inner surfaces of the pair of support walls 21, is supported in guide grooves 131 as an example of a guide part which guides the stopper 130 in the Y direction, and can slidingly move between the restriction position III and the restriction release position IV.

As described above, the stopper does not necessarily have to rotationally move between the restriction position and the restriction release position, and instead the stopper may be provided so as to slidingly move between the restriction position and the restriction release position. Therefore, the socket can be designed in accordance with application or the like, and the flexibility in designing sockets can be widened.

Third Embodiment

Figure 11:
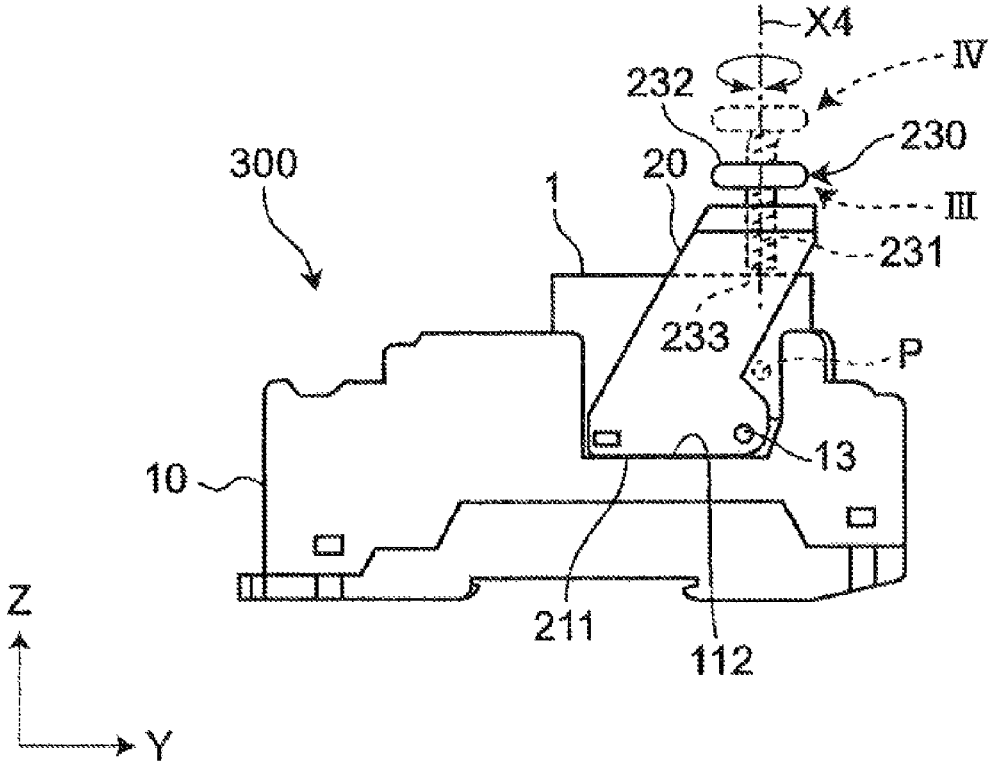
FIG. 11 is a side view of a socket of a third embodiment of the invention.

As shown in FIG. 11, a socket 300 of a third embodiment is different from the socket 100 of the first embodiment in that the socket 300 has a stopper 230 which can rotationally move between the restriction position III and the restriction release position IV.

Note that in the third embodiment, the same parts as in the first embodiment are assigned the same reference numerals and are not described again.

The stopper 230 is configured with: a screw shaft 231 which covers, in the plan view from the mounting direction Z1 of the relay 1, the center-of-gravity position P of the relay 1, and extends in the Z direction; and a screw head 232 provided on the upper end, in the Z direction, of the screw shaft 231. Regarding the stopper 230, when the screw head 232 is operated by fingers pinching the screw head 232 such that the screw shaft 231 is normally or reversely rotated around a rotation axis X4 extending in the mounting direction Z1 of the relay 1, the top end 233 moves between the restriction position III and the restriction release position VI.

The stopper does not necessarily have to rotationally move around the rotation shaft disposed between the pair of support walls between the restriction position and the restriction release position as described above, and instead the stopper may be provided to rotationally move, around a rotation axis extending in the mounting direction of the relay, between the restriction position and the restriction release position. Therefore, the socket can be designed to meet the application and the like, and the flexibility in designing sockets can be widened.

Note that on the top end of the screw shaft 231, there may be provided a guard portion having a diameter larger than the diameter of the screw shaft 231.

It is a matter of course that the components described in the above embodiments may be appropriately combined with one another or may be appropriately chosen, replaced, or removed.

A socket of one aspect of the invention may include: a socket body having a mounting part on which a relay is to be mounted in a mounting direction; and a holding lever supported on the mounting part of the socket body and configured to hold the relay mounted at a mounting position of the mounting part. The holding lever has: a support extending from the mounting part of the socket body in a removing direction opposite to the mounting direction; and a stopper provided on an end part of the support distal to the socket body in the removing direction and configured to restrict movement, of the relay positioned at the mounting position, in the removing direction. The stopper is provided on the support and configured to move between a restriction position at which the stopper restricts movement of the relay, positioned at the mounting position, in the removing direction from the mounting part and a restriction release position at which the stopper releases the restriction of the movement of the relay, positioned at the mounting position, in the removing direction from the mounting part. The holding lever is supported on the mounting part and configured to move between a retreat position at which, when the stopper is positioned at the restriction release position, a relay can be mounted at the mounting position of the mounting part and the relay mounted at mounting position can be removed and a holding position at which the relay positioned at the mounting position can be held when the stopper is positioned at the restriction position such that the stopper covers, in a plan view from the mounting direction, a center-of-gravity position of the relay.

A socket of one aspect of the invention may include: a stopper configured to move between a restriction position at which a relay cannot be removed and a restriction release position at which the relay is released; and a holding lever configured to hold the relay positioned at a mounting position when the stopper is positioned at the restriction position such that the stopper covers, in a plan view from a mounting direction, a center-of-gravity position of the relay. This arrangement can increase the force for holding the relay at the mounting position and can prevent the relay from unintentionally falling off from the mounting part of the socket body.

In a socket of an embodiment, the support is supported on the mounting part of the socket body and is configured to rotationally move, around a shaft perpendicularly crossing the mounting direction and the removing direction, between the retreat position and the holding position.

According to the above embodiment, the relay can be easily mounted on the mounting part of the socket body, and the relay positioned at the mounting position can be easily removed from the mounting part of the socket body.

In a socket of an embodiment, the support is a pair of support walls provided to sandwich the mounting part, and the pair of support walls has the perpendicularly crossing shaft which is provided at an end part proximal, in the removing direction, to the socket body and which extends in a direction crossing each of the pair of support walls, and the pair of support walls is supported on the mounting part to be rotatable around the perpendicularly crossing shaft between the retreat position and the holding position. The stopper has a rotation shaft which is provided at an end part distal, in the removing direction, to the socket body and which extends in such a direction that the rotation shaft crosses each of the pair of support walls, and is supported on the pair of support walls to be rotatable, around the rotation shaft, between the restriction position and the restriction release position.

According to the above embodiment, it is possible to reduce the operation range of the holding lever for mounting and removing the relay on and from the socket body.

In a socket of an embodiment, the support has a guide part configured to guide the stopper in a direction perpendicular to the mounting direction and the removing direction, and the stopper is supported on the guide part to be slidingly movable between the restriction position and the restriction release position.

According to the above embodiment, it is possible to design the socket in accordance with application or the like and thus to widen the flexibility in designing sockets.

In a socket of an embodiment, the stopper has: a rotation axis extending in the mounting direction, and a screw shaft whose one end is moved between the restriction position and the restriction release position when the screw shaft is normally or reversely rotated around the rotation axis.

According to the above embodiment, it is possible to design the socket in accordance with application or the like and thus to widen the flexibility in designing sockets.

In a socket of an embodiment, the holding lever has a locking mechanism to lock the stopper at the restriction position.

According to the above embodiment, it is possible to reliably prevent the relay from unintentionally falling off from the mounting part of the socket body.

In a socket of an embodiment, the locking mechanism is configured with: an engagement protrusion provided on any one of the stopper and the support; and an engagement receiving part which is provided on the other of the stopper and the support and with which the engagement protrusion can be locked, where the engagement protrusion and the engagement receiving part are detachably locked with each other.

The above embodiment makes it easier to visually recognize that the stopper is positioned at the restriction position, and the operability is thus improved.

INDUSTRIAL APPLICABILITY

A socket of an aspect of the invention is applicable to, for example, a socket for wiring a relay for board-mount use to a board.

The invention claimed is:

1. A socket comprising:

a socket body including a mounting part on which a relay is to be mounted in a mounting direction; and a holding lever supported on the mounting part of the socket body and configured to hold the relay mounted at a mounting position of the mounting part, wherein the holding lever includes:

a support extending from the mounting part of the socket body in a removing direction opposite to the mounting direction, the support being configured to rotationally move, around a shaft perpendicularly crossing the mounting direction and the removing direction, between a retreat position and a holding position; and a stopper provided on an end part of the support distal to the socket body in the removing direction and configured to restrict movement of the relay, positioned at the mounting position, in the removing direction, the stopper is provided on the support and configured to move between a restriction position and a restriction release position, wherein at the restriction position, the stopper restricts movement of the relay, positioned at the mounting position, in the removing direction from the mounting part, and wherein at the restriction release position, the stopper releases the restriction of the movement of the relay, positioned at the mounting position, in the removing direction from the mounting part, the holding lever is supported on the mounting part and configured to move between the retreat position and the holding position, wherein at the retreat position, when the stopper is positioned at the restriction release position, a relay can be mounted at the mounting position of the mounting part and the relay mounted at mounting position can be removed, and wherein at the holding position, the relay positioned at the mounting position can be held when the stopper is positioned at the restriction position such that the stopper covers, in a plan view from the mounting direction, a center-of-gravity position of the relay.

2. The socket according to claim 1, wherein the support is supported on the mounting part of the socket body.

3. The socket according to claim 1, wherein the support is a pair of support walls provided to sandwich the mounting part, the pair of support walls includes the perpendicularly crossing shaft which is provided at an end part proximal, in the removing direction, to the socket body and which extends in a direction crossing each of the pair of support walls, and the pair of support walls is supported on the mounting part to be rotatable around the perpendicularly crossing shaft between the retreat position and the holding position, and the stopper includes a rotation shaft which is provided at an end part distal, in the removing direction, to the socket body and which extends in such a direction that the rotation shaft crosses each of the pair of support walls, and is supported on the pair of support walls to be rotatable, around the rotation shaft, between the restriction position and the restriction release position.

4. The socket according to claim 1, wherein the support includes a guide part configured to guide the stopper in a direction perpendicular to the mounting direction and the removing direction, and the stopper is supported on the guide part to be slidingly movable between the restriction position and the restriction release position.

5. The socket according to claim 1, wherein the stopper includes:

a rotation axis extending in the mounting direction, and a screw shaft whose one end is moved between the restriction position and the restriction release position when the screw shaft is normally or reversely rotated around the rotation axis.

6. The socket according to claim 1, wherein the holding lever includes a locking mechanism to lock the stopper at the restriction position.

7. The socket according to claim 6, wherein the locking mechanism is configured with:

an engagement protrusion provided on any one of the stopper and the support; and an engagement receiving part which is provided on the other of the stopper and the support and with which the engagement protrusion can be locked, and wherein the engagement protrusion and the engagement receiving part are detachably locked with each other.

8. The socket according to claim 1, wherein the holding lever further comprises a removing part provided to the support of the holding lever and configured to move the relay in the removing direction from the mounting position along with the movement of the holding lever from the holding position to the retreat position.

9. The socket according to claim 8, wherein the mounting part includes a groove portion in which the removing part of the holding lever is accommodated in the state where the holding lever is positioned at the holding position.

10. The socket according to claim 8, further comprising the removing part comprises a rod parallel to a rotational axis of the holding lever.

11. A socket comprising:

a socket body including a mounting part on which a relay is to be mounted in a mounting direction; and a holding lever supported on the mounting part of the socket body and configured to hold the relay mounted at a mounting position of the mounting part, wherein the holding lever includes:

a support extending from the mounting part of the socket body in a removing direction opposite to the mounting direction; and a stopper provided on an end part of the support distal to the socket body in the removing direction and configured to restrict movement of the relay, positioned at the mounting position, in the removing direction, the stopper is provided on the support and configured to move between a restriction position and a restriction release position, wherein at the restriction position, the stopper restricts movement of the relay, positioned at the mounting position, in the removing direction from the mounting part, and wherein at the restriction release position, the stopper releases the restriction of the movement of the relay, positioned at the mounting position, in the removing direction from the mounting part, the holding lever is supported on the mounting part and configured to move between a retreat position and a holding position, wherein at the retreat position, when the stopper is positioned at the restriction release position, a relay can be mounted at the mounting position of the mounting part and the relay mounted at mounting position can be removed, and wherein at the holding position, the relay positioned at the mounting position can be held when the stopper is positioned at the restriction position such that the stopper covers, in a plan view from the mounting direction, a center-of-gravity position of the relay, the support is a pair of support walls provided to sandwich the mounting part, the pair of support walls includes a perpendicularly crossing shaft which is provided at an end part proximal, in the removing direction, to the socket body and which extends in a direction crossing each of the pair of support walls, and the pair of support walls is supported on the mounting part to be rotatable around the perpendicularly crossing shaft between the retreat position and the holding position, and the stopper includes a rotation shaft which is provided at an end part distal, in the removing direction, to the socket body and which extends in such a direction that the rotation shaft crosses each of the pair of support walls, and is supported on the pair of support walls to be rotatable, around the rotation shaft, between the restriction position and the restriction release position.

12. A socket comprising:

a socket body including a mounting part on which a relay is to be mounted in a mounting direction; and a holding lever supported on the mounting part of the socket body and configured to hold the relay mounted at a mounting position of the mounting part, wherein the holding lever includes:

a support extending from the mounting part of the socket body in a removing direction opposite to the mounting direction; and a stopper provided on an end part of the support distal to the socket body in the removing direction and configured to restrict movement of the relay, positioned at the mounting position, in the removing direction, the stopper is provided on the support and configured to move between a restriction position and a restriction release position, wherein at the restriction position, the stopper restricts movement of the relay, positioned at the mounting position, in the removing direction from the mounting part, and wherein at the restriction release position, the stopper releases the restriction of the movement of the relay, positioned at the mounting position, in the removing direction from the mounting part, the holding lever is supported on the mounting part and configured to move between a retreat position and a holding position, wherein at the retreat position, when the stopper is positioned at the restriction release position, a relay can be mounted at the mounting position of the mounting part and the relay mounted at mounting position can be removed, and wherein at the holding position, the relay positioned at the mounting position can be held when the stopper is positioned at the restriction position such that the stopper covers, in a plan view from the mounting direction, a center-of-gravity position of the relay, the support includes a guide part configured to guide the stopper in a direction perpendicular to the mounting direction and the removing direction, and the stopper is supported on the guide part to be slidingly movable between the restriction position and the restriction release position.

13. The socket according to claim 12, wherein the holding lever further comprises a removing part provided to the support of the holding lever and configured to move the relay in the removing direction from the mounting position along with the movement of the holding lever from the holding position to the retreat position.

14. The socket according to claim 13, wherein the mounting part includes a groove portion in which the removing part of the holding lever is accommodated in the state where the holding lever is positioned at the holding position.

15. The socket according to claim 13, further comprising the removing part comprises a rod parallel to a rotational axis of the holding lever.

16. A socket comprising:

a socket body including a mounting part on which a relay is to be mounted in a mounting direction; and a holding lever supported on the mounting part of the socket body and configured to hold the relay mounted at a mounting position of the mounting part, wherein the holding lever includes:

a support extending from the mounting part of the socket body in a removing direction opposite to the mounting direction; and a stopper provided on an end part of the support distal to the socket body in the removing direction and configured to restrict movement of the relay, positioned at the mounting position, in the removing direction, the stopper is provided on the support and configured to move between a restriction position and a restriction release position, wherein at the restriction position, the stopper restricts movement of the relay, positioned at the mounting position, in the removing direction from the mounting part, and wherein at the restriction release position, the stopper releases the restriction of the movement of the relay, positioned at the mounting position, in the removing direction from the mounting part, the holding lever is supported on the mounting part and configured to move between a retreat position and a holding position, wherein at the retreat position, when the stopper is positioned at the restriction release position, a relay can be mounted at the mounting position of the mounting part and the relay mounted at mounting position can be removed, and wherein at the holding position, the relay positioned at the mounting position can be held when the stopper is positioned at the restriction position such that the stopper covers, in a plan view from the mounting direction, a center-of-gravity position of the relay, an engagement protrusion is provided on any one of the stopper and the support, an engagement receiving part is provided on the other of the stopper and the support and with which the engagement protrusion can be locked, and the engagement protrusion and the engagement receiving part are detachably locked with each other.

17. The socket according to claim 16, wherein the holding lever further comprises a removing part provided to the support of the holding lever and configured to move the relay in the removing direction from the mounting position along with the movement of the holding lever from the holding position to the retreat position.

18. The socket according to claim 17, wherein the mounting part includes a groove portion in which the removing part of the holding lever is accommodated in the state where the holding lever is positioned at the holding position.

19. The socket according to claim 17, further comprising the removing part comprises a rod parallel to a rotational axis of the holding lever.

* * * * *